US006602337B1

(12) United States Patent
Lawry

(10) Patent No.: US 6,602,337 B1
(45) Date of Patent: Aug. 5, 2003

(54) TARGET AND PROCESS FOR MANUFACTURING TARGETS

(75) Inventor: Bob Lawry, Cayuga (CA)

(73) Assignee: Lawry Shooting Sports Inc., Caledonia (CA)

( * ) Notice: Subject to any disclaimer, the term of this patent is extended or adjusted under 35 U.S.C. 154(b) by 0 days.

(21) Appl. No.: 10/218,512

(22) Filed: Aug. 15, 2002

(30) Foreign Application Priority Data

Aug. 9, 2001 (CA) ..... 2397209

(51) Int. Cl.[7] ..... B08L 95/00; B29B 13/02; B29C 70/00

(52) U.S. Cl. ..... 106/284; 106/284.01; 264/122

(58) Field of Search ..... 106/284, 284.01; 264/122

(56) References Cited

U.S. PATENT DOCUMENTS

| | | | | |
|---|---|---|---|---|
| 2,831,778 A | | 4/1958 | Allison et al. | 106/281 |
| 3,399,255 A | | 8/1968 | Moehlman et al. | 264/117 |
| 4,623,150 A | | 11/1986 | Moehlman et al. | 273/362 |
| 5,947,475 A | | 9/1999 | Skeuse et al. | 273/363 |
| 6,394,457 B2 | * | 5/2002 | Spencer et al. | 273/363 |
| 6,428,007 B2 | * | 8/2002 | Skeuse et al. | 273/362 |

FOREIGN PATENT DOCUMENTS

| | | | |
|---|---|---|---|
| CA | 1245783 | 11/1988 | F41J/9/16 |
| CA | 2260806 | 11/1998 | F41J/9/16 |
| CA | 2270826 | 11/1999 | F41J/9/16 |
| CA | 2285785 | 4/2000 | F41J/1/01 |

* cited by examiner

*Primary Examiner*—Stephen J. Lechert, Jr.
(74) *Attorney, Agent, or Firm*—Dimock Stratton Clarizio; Mark B. Eisen

(57) ABSTRACT

A process for manufacturing a non-toxic environmentally friendly target comprising petroleum pitch and filler includes the steps of pre-heating the petroleum pitch binder to at least 450° F., mixing the petroleum pitch binder with limestone filler so that toxins in the petroleum pitch binder are neutralized, and setting the mixture into target molds. The petroleum pitch binder and filler are preferably mixed for at least 2 hours at a temperature of at least 400° F.

20 Claims, No Drawings

TARGET AND PROCESS FOR MANUFACTURING TARGETS

FIELD OF THE INVENTION

The invention relates to the field of targets and more particularly to a process for manufacturing non-toxic environmentally friendly targets for trap, skeet and sport shooting.

BACKGROUND OF THE INVENTION

Targets for trap, skeet and sport shooting are circular discs that are propelled into the air to create a target for shooting. Once the target is shot it is shattered into numerous pieces, which disperse onto the ground. The pieces are often left untouched, so that they can degrade into the ground. As most conventional targets are made of potentially hazardous materials, this results in serious environmental concerns associated with using targets.

Commercial targets are often referred to as "clay targets" arising from the fact that the earliest known targets were made of clay. At the turn of the century, targets were comprised of river silt and coal tar. The river silt was eventually replaced with pulverized limestone. When a new petroleum binder was developed in the 1970's, commercial targets were then prepared using petroleum pitch binder and filler such as limestone. Examples of such targets are disclosed in U.S. Pat. Nos. 2,831,778 and 3,399,255.

Although petroleum pitch binder is much less toxic than coal tar binders, it still contains polynuclear aromatic hydrocarbons, which are carcinogens that are damaging to the environment. Such carcinogens include cyrysene, benzo (a)pyrene and benzo(a) anthrance.

There have been several attempts in the prior art to reduce the risk of toxicity to the environment from shattered targets by constructing targets without pitch. U.S. Pat. No. 5,947, 475 to Skeuse, for example, discloses a pitch-free target comprising sulfur binder and filler. The target also has high frangibility as a result of being cast in an unstable state. The targets is manufactured by heating the ingredients to a temperature above which the structure of the material changes (320° F. for sulfur), maintaining the temperature for an extended period of time to effect change (preferably one hour for sulfur) and casting the targets below this temperature to yield a target that is in an unstable physical state and will shatter on impact.

U.S. Pat. No. 4,623,150 to Mehlman also discloses a target free of pitch, which is less toxic, projectable and frangible. The target is comprised of limestone filler and an organic or inorganic pitch-free binder and is prepared without heating the binder to its thermal decomposition point. Instead, the limestone filler is wet with solvent so that agglomerates of the filler, binder and solvent can be produced by compression forming the agglomerates. In this target, the limestone filler comprises between 85 and 96% by weight of the target and the binder between 4 and 15% by weight.

While the targets disclosed in the prior art had improved properties, none of the prior art patents disclose a process for manufacturing non-toxic environmentally friendly targets from petroleum pitch and filler. There therefore remains a need to develop targets comprising petroleum pitch and filler that are non-toxic environmentally friendly.

SUMMARY OF THE INVENTION

It is an object of the present invention to provide a non-toxic environmentally friendly target for trap, skeet and sport shooting that comprises petroleum pitch and filler.

According to one aspect of the invention, there is provided a process for manufacturing environmentally friendly targets for trap, skeet and sport shooting, said process comprising the steps of: (a) heating a petroleum pitch binder to at least 450° F.; (b) mixing the petroleum pitch binder with filler so that toxins in the petroleum pitch binder are neutralized; and, (c) setting the mixture of step (b) into target molds.

In a preferred embodiment, the filler is calcium limestone and the petroleum pitch binder and filler are mixed in a high-speed mixer for at least 2 hours at a temperature of at least 400° F.

In a further preferred embodiment of the invention, non-toxic, environmentally friendly targets are manufactured by this process.

The process disclosed by the present invention has many advantages. In particular, it provides a process by which the filler neutralizes the carcinogens found in petroleum pitch, thereby eliminating the toxicity effects normally associated with constructing a target from petroleum pitch.

Numerous other objectives, advantages and features of the process will also become apparent to the person skilled in the art upon reading the detailed description of the preferred embodiments, the examples and the claims.

DETAILED DESCRIPTION OF THE INVENTION

The invention relates to a process for manufacturing non-toxic environmentally friendly targets comprised of filler and petroleum pitch binder.

The standard process for manufacturing targets uses petroleum pitch binder in a cold, flaked, or pelleted form. The petroleum pitch binder and filler are heated and mixed in a horizontal mixer until the mixture is uniform and liquefied and can be pumped into target molds. In general, the petroleum pitch binder and filler mixture is liquefied at about 350° F.

In the present invention, the petroleum pitch binder is preheated to a temperature of at least 450° F. At this temperature the petroleum pitch binder is liquefied.

The petroleum pitch binder and filler are then mixed at a temperature of about 400° F. for at least 2 hours. The petroleum pitch binder and filler are mixed using a high-speed mixer with improved temperature control. In a preferred embodiment of the invention a large ribbon mixer is used. This mixer is configured to mix the materials more vigorously than conventional mixers by providing longer horizontal fins that produce continuous and thorough mixing.

The polynuclear toxins (chyrese, benzo(a)pyrene and benzo(a)anthracene) in the petroleum pitch binder are neutralized by the filler during mixing at this temperature by breaking the chemical bonds between the aromatic rings in the toxins. Once the neutralization is complete, the mixture is then cast at its elevated temperature into target molds.

In a preferred embodiment, the petroleum pitch binder used in this process is comprised of about 40% carbon. A suitable petroleum pitch binder that can be used for this invention is sold by Premcor Refining and Marathon Ashland Petroleum LLC under product code CAS 68187-56-6.

In a preferred embodiment of the invention, the filler is calcium limestone. Most preferably the filler is calcium pulverized limestone F grade filler. The particle size of the calcium limestone is at least 35 mesh and substantially 200 mesh. This particle size is important to the rate of neutralization of the toxins in the petroleum pitch binder and the fragility and brittleness of the target.

The target made from this process is comprised of about 60 to 70% calcium limestone and 30–40% petroleum pitch binder. Most preferably the targets are comprised of about 65% calcium limestone and about 35% petroleum pitch binder.

The following example further illustrates the invention.

EXAMPLE 100 tons of petroleum 250 pitch binder is heated to 450–500° F. until liquefied while 200 tons of calcium pulverized limestone F grade is heated to ambient temperature. The petroleum pitch binder and calcium limestone are then fed into one end of a large ribbon mixer and mixed at 100 rpm for 2 hours at 450° F. The mixture is then poured into target molds.

The resulting targets weighed 99.25 grams and were non-toxic.

Although the present invention has been shown and described with respect to its preferred embodiments it will be understood by those skilled in the art that other changes, modifications, additions and omissions may be made without departing from the substance and the scope of the present invention as defined by the attached claims.

I claim:

1. A process for manufacturing environmentally friendly targets for sport, trap and skeet shooting, said process comprising the steps of:

(a) heating a petroleum pitch binder to at least 450° F.;

(b) mixing the petroleum pitch binder with filler so that toxins in the petroleum pitch binder are neutralized; and, (c) setting the mixture of step (b) into target molds.

2. The process of claim 1 wherein the petroleum pitch binder and filler are mixed at a temperature of at least 400° F.

3. The process of claim 1 wherein the petroleum pitch binder and filler are mixed in a high-speed mixer.

4. The process of claim 1 wherein the petroleum pitch binder and filler are mixed for at least 2 hours.

5. The process of claim 2 wherein the petroleum pitch binder and filler are mixed at a temperature between 400 and 500° F.

6. The process of claim 1 wherein step (a) occurs at a temperature between 450–500° F.

7. The process of claim 1 wherein the filler is calcium limestone.

8. The process of claim 7 wherein the calcium limestone has a particle size that is at least 35 mesh and substantially 200 mesh.

9. The process of claim 1 wherein 100 tons of petroleum pitch binder is used in step (a).

10. The process of claim 9 wherein 200 tons of filler is used in step (b).

11. A non-toxic, environmentally friendly target manufactured by the process of claim 1.

12. The non-toxic environmentally friendly target of claim 11 wherein the petroleum pitch binder comprises between 30 and 40 weight % of the target.

13. The non-toxic environmentally friendly target of claim 12 wherein the filler comprises between 60 and 70 weight % of the target.

14. A non-toxic, environmentally friendly target manufactured by the process of claim 2.

15. A non-toxic, environmentally friendly target manufactured by the process of claim 3.

16. A non-toxic, environmentally friendly target manufactured by the process of claim 4.

17. A non-toxic, environmentally friendly target manufactured by the process of claim 5.

18. A non-toxic, environmentally friendly target manufactured by the process of claim 6.

19. A non-toxic, environmentally friendly target manufactured by the process of claim 7.

20. A non-toxic, environmentally friendly target manufactured by the process of claim 8.

* * * * *